United States Patent [19]

Ikeda et al.

[11] Patent Number: 4,980,834

[45] Date of Patent: Dec. 25, 1990

[54] AIR-TO-FUEL RATIO CONTROL SYSTEM

[75] Inventors: Tatsuji Ikeda; Tetsushi Hosokai; Masaki Fujii; Tetsuya Takata, all of Hiroshima, Japan

[73] Assignee: Mazda Motor Corporation, Hiroshima, Japan

[21] Appl. No.: 213,384

[22] Filed: Jun. 30, 1988

[30] Foreign Application Priority Data

Jun. 30, 1987 [JP] Japan ..... 62-164587

[51] Int. Cl.[5] ..... F02M 51/00

[52] U.S. Cl. ..... 364/431.05; 73/118.2; 123/440; 123/479

[58] Field of Search ..... 364/431.05, 431.11; 123/440, 489, 479; 73/23, 117.3, 118.2, 118.1

[56] References Cited

U.S. PATENT DOCUMENTS

| | | | |
|---|---|---|---|
| 3,938,075 | 2/1976 | Reddy | 123/479 |
| 4,019,474 | 4/1977 | Nishimya et al. | 123/489 |
| 4,252,098 | 2/1981 | Tomczak et al. | 123/489 |
| 4,671,243 | 6/1987 | Deutsch | 123/489 |
| 4,677,955 | 7/1987 | Takao | 123/489 |
| 4,729,359 | 3/1988 | Tomisawa et al. | 123/489 |
| 4,777,922 | 10/1988 | Mieno et al. | 123/479 |
| 4,825,838 | 5/1989 | Osuga et al. | 123/440 |

*Primary Examiner*—Parshotam S. Lall
*Assistant Examiner*—Ellis B. Ramirez
*Attorney, Agent, or Firm*—Fleit, Jacobson, Cohn, Price, Holman & Stern

[57] ABSTRACT

An air-to-fuel ratio control system executes a feedback control of air-to-fuel ratio based on an output of an oxygen sensor. The oxygen sensor is judged to be active when a change of the output therefrom occurs to make a fuel mixture rich. For detecting the failure or breakdown of the oxygen sensor when the feedback air-to-fuel control is suspended, the air-to-fuel ratio control system comprises an activity sensor for detecting whether the oxygen sensor is active or inactive, an air-to-fuel ratio altering device for enforcing an alteration of air-to-fuel ratio to make a fuel mixture rich, and a judging device for judging the oxygen sensor to be broken down when no activity detection is made while the alteration of air-to-fuel ratio has been effected.

9 Claims, 7 Drawing Sheets

AIR-TO-FUEL RATIO CONTROL SYSTEM

BACKGROUND OF THE INVENTION

This invention relates to an air-to-fuel ratio control system for a vehicle engine and more particularly to an air-to-fuel ratio control system which can make an judgement of inactivity of an exhaust sensor when the vehicle engine is in a specified operating range.

There are heretofore known various feedback or closed loop fuel mixture control systems in which an air-to-fuel ratio detector or exhaust sensor is sensitive to the oxygen content of the exhaust. The fuel mixture control system determines the proper air-to-fuel ratio and constantly monitors the exhaust to verify the accuracy of the air-to-fuel mixture setting. For avoiding improper operation of such an air-to-fuel ratio control system in the case of a breakdown or failure of the air-to-fuel ratio detector or exhaust sensor, it is necessary to detect whether the air-to-fuel ratio detector operates normally or not.

One such air-to-fuel ratio control system being capable of finding a breakdown or failure of the air-to-fuel ratio detector is disclosed in, for example, Japanese patent application No. 59-27,820 filed on Feb. 16, 1984 and laid open to the public on Sept. 6, 1985 under the publication No. 60-173,332. The air-to-fuel ratio control device disclosed in the above mentioned application decides a failure of the air-to-fuel ratio detector when the air-to-fuel ratio detector provides an output representative of a lean mixture under the condition that the quantity of fuel delivered to the airstream is correctively altered not decreasingly but increasingly in open loop fuel control while a vehicle engine is in motion under a specified operating condition.

This failure decision is based on an assumption that the fuel mixture will actually become rich when a fundamental quantity of fuel to be delivered is controlled to alter increasingly in open loop fuel control. However, even when the above condition is satisfied, if an increasing correction value is small, an actual fuel mixture sometimes tends to become lean due to the scattering of the measured quantity of intake air and/or of the quantity of fuel delivered to the airstream by the fuel injector, resulting in an inaccurate failure detection of activity of the air-to-fuel ratio detector. In the case of making such a failure decision of the air-to-fuel ratio detector only when an increasing correction value has become sufficiently large in an attempt at overcoming the above stated inaccurate failure decision, limits of engine operating condition wherein a large value of increasing correction value is attained will become too narrow, resulting in little opportunity to detect a failure of the air-to-fuel ratio detector.

OBJECT OF THE INVENTION

It is, therefore, an object of the present invention to provide an air-to-fuel ratio control system in which an accurate failure detection of an air-to-fuel ratio detector can be certainly performed even when an actual mixture is lean due to such as an inaccurate measurement of intake air by an air flow meter.

SUMMARY OF THE INVENTION

According to the present invention, the feedback air-to-fuel ratio control system of a vehicle engine of the type that an air-to-fuel ratio detector or exhaust sensor is judged to be operating normally or broken down under a suspension of feedback or closed loop fuel control when the vehicle engine is in motion in a previously determined or selected operating condition comprises air-to-fuel ratio detecting means such as an exhaust sensor which is sensitive to the oxygen content of the exhaust gas to provide an output proportional to the oxygen content; activity judging means for judging the activity of the exhaust sensor based on whether the exhaust sensor provides an output turned so as to make a fuel mixture rich; air-to-fuel ratio altering means for enforcingly increasingly altering the air-to-fuel ratio so as to make an air-fuel mixture rich when no judgement of the activity of the exhaust sensor by the activity judging means; and failure decision means for making the decision of a breakdown of the exhaust sensor when, although the air-to-fuel altering means has executed an alteration of air-to-fuel ratio as a result of the activity judgement of the exhaust sensor by the activity judging means, the exhaust sensor is not judged to be active.

According to a feature of the present invention, the air-to-fuel ratio control system determines a proper air-to-fuel ratio in feedback or closed loop fuel control and then constantly monitors its exhaust to verify the accuracy of the mixture setting. Whenever the exhaust sensor determines the oxygen content is off, the system corrects itself to bring the oxygen content back to proper levels. In addition to the feedback fuel control system, the system of the present invention is provided with the activity judging means, air-to-fuel altering means and failure decision means for making a deciding of inactivity or breakdown of the exhaust sensor so as to make a decision whether the exhaust sensor is active or inactive after having made an actual fuel mixture rich by enforcingly increasingly altering the air-to-fuel ratio.

BRIEF DESCRIPTION OF THE DRAWINGS

The above and other object and features of the present invention will become apparent from the following detailed description taken in conjunction with the preferred embodiments thereof with reference with the accompanying drawings in which.

DETAILED DESCRIPTION OF THE INVENTION

Because vehicle engines are well known, the present description will be directed in particular to elements forming parts of, or cooperation directly with, the system in accordance with the present invention. It is to be understood that elements not specifically shown or described can take various forms well known to those skilled in the vehicle engine art.

Figure 1:
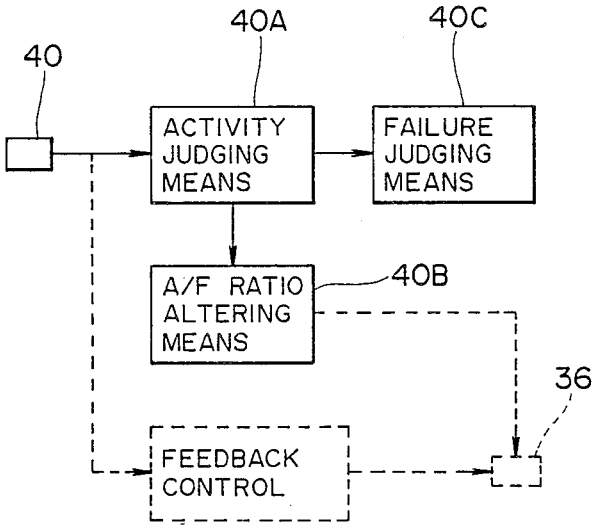
FIG. 1 is a schematic block diagram showing an essential structure of the air-to-fuel ratio control system according to the present invention.

Referring now to FIG. 1, shown therein in a block diagram is the principal construction of the air-to-fuel ratio control system in accordance with the present invention. The air-to-fuel fuel ratio control system is of the type having an air-to-fuel ratio detector or exhaust sensor such as an oxygen sensor 40 whose output governs air-to-fuel ratio control and being adapted to detect an inactivity or failure of the oxygen sensor 40 when feedback control is suspended while a vehicle engine is operated under a specified operating condition.

The oxygen sensor 40 provides an appropriate output signal proportional to the oxygen content of the exhaust. The air-to-fuel ratio control system comprises activity judging means 40A provided in association with the oxygen sensor 40 for judging whether the oxygen sensor 40 is active or inactive based on an occurrence of change of the output from the oxygen sensor 40 which causes the quantity of fuel delivered to the airstream; air-to-fuel ratio (A/F ratio) altering means 40B for altering the air-to-fuel ratio to enforce an increase of the quantity of fuel to be delivered to the airstream so as to make a fuel mixture rich when the activity judging means 40A executes no activity judgement of the oxygen sensor 40; and failure judging means 40C for determining the oxygen sensor 40 to have a breakdown when, even though the air-to-fuel ratio has altered the air-to-fuel ratio, the activity judging means 40B has executed no activity judgement. Specifically, when the vehicle engine is normally operated in an operating condition suitable for feedback fuel control, the quantity of fuel delivered to the airstream through a fuel injector 36 is correctively controlled according to an output of the oxygen sensor 40 by the feedback fuel control system shown by a broken line in FIG. 1.

In the event that the oxygen sensor 40 is put out of being judged as to its activity as long as it is left intact, after an air-to-fuel ratio is altered to enforce an increase of fuel delivered to the airstream so as to make actually a fuel mixture rich, a failure judgement of the oxygen sensor 40 is conducted.

Figure 2:
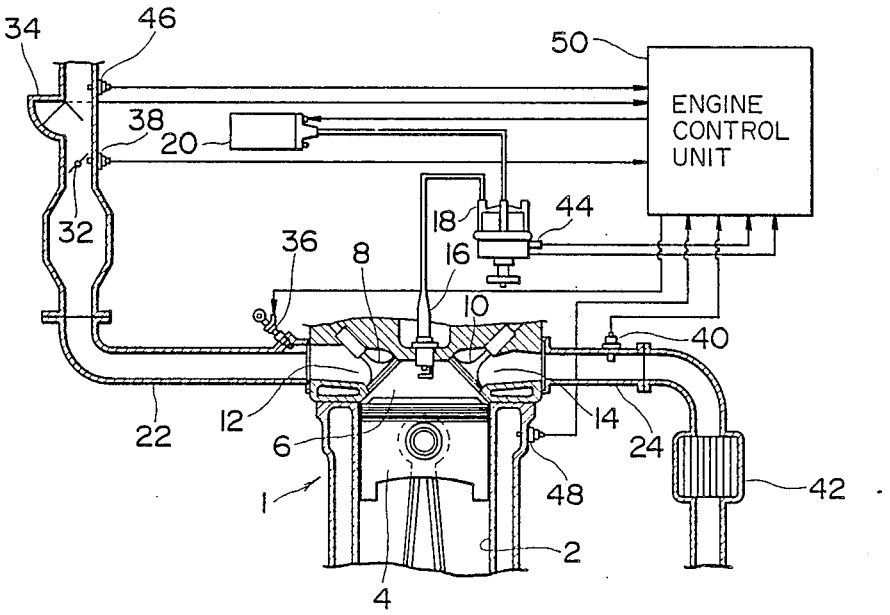
FIG. 2 is a schematic illustration showing a vehicle engine embodying the present invention.

Referring now to FIG. 2, there is shown various elements of an internal combustion engine of a vehicle provided with the air-to-fuel ratio control device in accordance with the present invention. The vehicle engine in FIG. 2 has an engine block 1 formed with a cylinder 2 slidably receiving a piston 4 and a combustion chamber 6 therein. Facing on the combustion chamber 6, there are disposed intake and exhaust valves 8 and 10 seated in intake and exhaust ports 12 and 14 formed in the engine block 1, respectively. At the top of the combustion chamber 6, there is a spark plug 16 threaded into the engine block 1. This spark plug 16, in cooperation with a distributor 18 and an ignition coil 20, constitutes a firing system well known in the art. The combustion chamber 6 is in communication with intake and exhaust manifolds 22 and 24 through the intake and exhaust ports 12 and 14, respectively.

In the intake manifold 22, there are a throttle valve 32 for controlling quantity of air-fuel mixture reaching the combustion chamber 6, an air-flow meter 34 disposed before the throttle valve 32 for determining air flow, and a fuel injector 36 disposed adjacent to the intake port 12. In association with the throttle valve 32, a throttle valve position sensor 38 is provided to send an appropriate output signal indicating whether the throttle valve is in the idle or full throttle position to a microcomputer as an engine control unit (ECU) 50.

On the other hand, an oxygen sensor 40 is threaded into the exhaust manifold 24 to send information regarding quantity of the oxygen content in the exhaust gas to the engine control unit 50. After the oxygen sensor 40 in the exhaust system, there is a catalytic converter 42 to significantly lower emission levels of hydrocarbons, carbon monoxide, and in the case of some converters, oxides of nitrogen as is well known in the art.

The engine control unit 50 receives signals from a crank angle sensor 44 for detecting engine rpm, an air flow temperature sensor 46 and an engine coolant temperature sensor 48 as well as the throttle valve position sensor 38, the air flow meter 34 and the oxygen sensor 40 and controls the ignition system and the fuel injector 36.

The engine control unit 50 controls the fuel injector 36 to inject a proper quantity of fuel in such a way to bring the air-to-fuel ratio to a proper value based on an output from the oxygen sensor 40 when the vehicle engine is operated under a feedback-controllable operating condition such as operating conditions other than a warming up operating condition, a high load operating condition, a rapid acceleration operating condition and so forth. In addition to the control of the fuel injector 36, the engine control unit 50 executes a sequence routine for, when the vehicle engine is operated under a specified operating condition, judging a failure of the oxygen sensor 40. It is noted that the specified operating condition in this specification refers to the fact that the vehicle engine is operated at a speed in rpm larger than 1,500 under the feedback-controllable operating condition.

The operation of the air-to-fuel ratio control system depicted in FIG. 2 is best understood by reviewing FIGS. 3 to 7, which are flow charts illustrating various routines for the microcomputer in the engine control unit 50. Programming a microcomputer is a skill well understood in the art. The following description is written to enable a programmer having ordinary skill in the art to prepare an appropriate program for the microcomputer. The particular details of any such program would of course depend upon the architecture of the particular microcomputer selected.

Figure 3A:
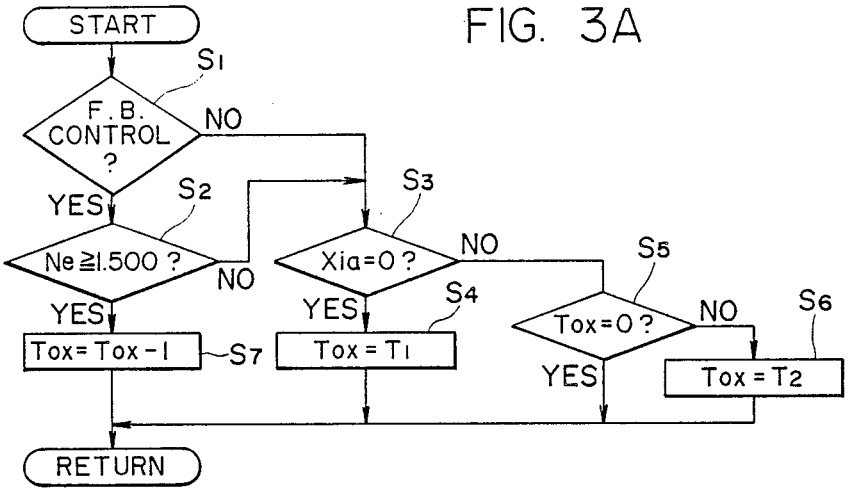
FIG. 3A is a flow chart showing a timer setting sequential routine for a microcomputer which controls the air-to-fuel ratio control system of FIG. 1.
Figure 3B:
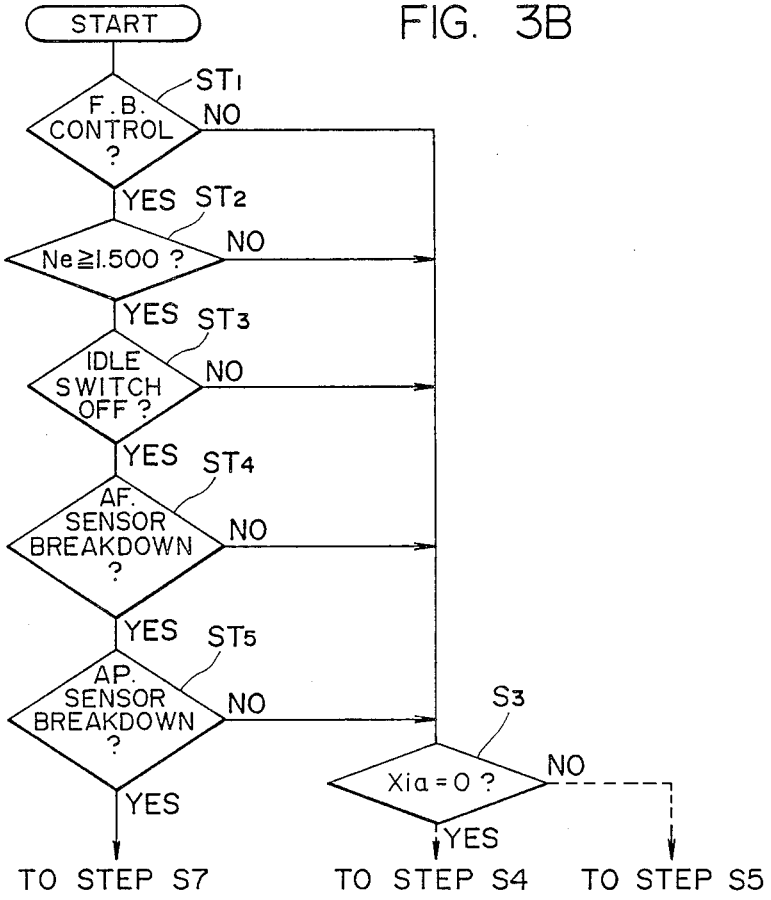
FIG. 3B is a flow chart similar to that of FIG. 3A but showing a timer setting sequential routine in an alternate embodiment of the present invention.

Referring to FIG. 3A, which is a flow chart of a timer setting routine for the microcomputer for setting a standby time period after which a judgement of failure of the oxygen sensor 40 is conducted and the quantity of fuel is increasingly varied to alter the air-to-fuel ratio, firstly decided is whether the vehicle engine is operated under the specified operating condition. It is to be understood that the vehicle engine is assumed to be in the specified operating condition upon all the following occurrences:

(1) The fuel control system is under feedback control;

(2) The engine speed $N_e$ is as high as or higher than 1,500 rpm;
(3) An idle switch is turned off;
(4) The air flow sensor is normally operating; and
(5) An atmospheric pressure sensor is normally operating.

Therefore, assuming the above conditions (3) to (5) are verified, in order to examine as to whether the vehicle engine is operating under the specified operating condition suitable for introducing a decision of failure of the air-to-fuel ratio sensor, the first and second steps S1 and S2 are firstly executed.

The first decision in the step S1 in the routine is to decide whether the vehicle engine 1 is operating under an operating condition suitable for feedback (abbreviated by F.B. in FIG. 3A) or closed loop fuel control or not. If the answer to the first decision is yes, then another decision is made in the step: "is the engine speed $N_e$ in rpm larger than 1,500 ?" If the answer to either one of the decisions in the steps S1 and S2 is no, this indicates that in fact the vehicle engine 1 is operating out of the limits of the specified operating condition. Then, a decision is made in a step S3: "has a fuel increasing judging flag $X_{ia}$ been set to zero (0) in the failure decision routine ?" The fuel increasing judging flag $X_{ia}$ indicates the failure increasing judging history of the air-to-fuel ratio control system. In particular, a fuel increasing judging flag $X_{ia}=0$ is set in the event that the failure judging of the oxygen sensor 40 has not been executed in the failure decision routine shown in FIG. 7 and, on the other hand, a failure increasing judging flag $X_{ia}=1$ in the event of having been executed. If the fuel increasing judging flag $X_{ia}=0$ is detected, a timer counter $T_{ox}$ is set to a first standby time period $T_1$, for example desirably approximately 85 sec. in this embodiment, in a step S4. This standby time period T indicates a time period from the moment the vehicle engine reaches the specified operating condition to the beginning of an increasing alteration of the quantity of fuel delivered to the airstream. Otherwise, namely the fuel increasing judging flag $X_{ia}=1$ which indicates the failure decision was being effected for at least the first standby time $T_1$ is detected, then, the timer counter $T_{ox}$ is set to a second standby time period $T_2$, for example desirably approximately 10 sec. in this embodiment, in a step S6 if the timer counter $T_{ox}$ has counted at least one. If the timer counter $T_{ox}$ has counted nothing, a step S5 orders return to the first step S1.

If the answer to the decision in the step S2 regarding the specific operating condition, in particular the engine speed, is yes, then, the timer counter $T_{ox}$ decrements its counts by one in a step S7.

For more accurate timer setting, it is desirable to replace the steps S1 and S2 with steps ST1 through ST6. In these steps, various decisions are made in order to determine whether the vehicle engine is operating under the specified operating condition. Specifically, the first and second decisions in the steps ST1 and ST2 are just the same as in the steps S1 and S2. In the steps ST3 to ST5, conditions of an idle switch, an air-flow (abbreviated by AF in FIG. 3B) sensor and an atmospheric pressure (abbreviated by AP in FIG. 3B) sensor are read in order. In the case that the answer to any decision is no, then the step S3 of the timer setting routine of FIG. 3A is executed to make the decision regarding the fuel increasing judging history. On the other hand, the answer to every decision is yes, this indicates the engine vehicle is operating under the specified operating condition, then the step S7 is executed to decrement the timer counter $T_{ox}$ by one (1).

Figure 4A:
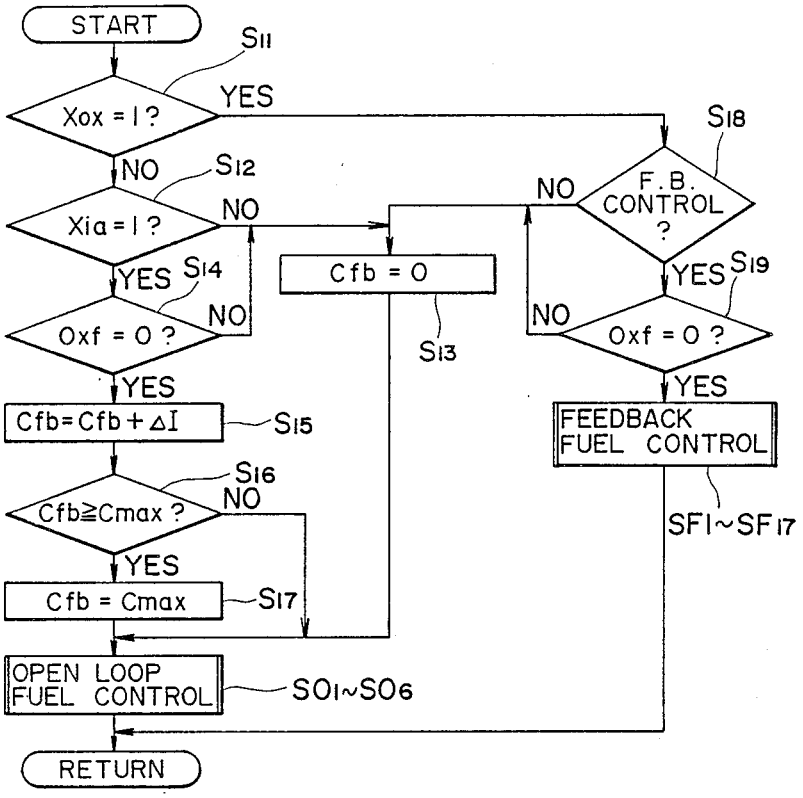
FIG. 4A is flow chart showing a fuel control sequential routine for the microcomputer.

Reference is now had to FIG. 4A showing a flow chart of the fuel control routine, wherein an activity judging flag $X_{ox}$ indicates the result of an activity decision in the fuel control routine even in the failure judging routine which will be described in detail later in connection with in FIG. 5. Specifically, when an activity judging circuit in the engine control unit 50 detects a sensor output voltage from the oxygen sensor 40 larger than a previously specified voltage, the oxygen sensor 40 is judged to be active, setting an active flag $X_{ox}=1$. The activity flag $X_{ox}=1$ once set is maintained unchanged till the vehicle engine is shut off. In the fuel control routine, the first decision in a step S11 is to read the activity judging $X_{ox}$. If an inactive flag $X_{ox}=0$ is detected, namely the answer to the decision in the step S11 is no, another decision is made in a step S12: "has the fuel increasing judging flag $X_{ia}=1$ been set ?" When the answer to the other decision is no, then, a feedback correction value $C_{fb}$ is set to and maintained at zero (0) in a step S13 till the fuel increasing flag $X_{ia}=1$ is set in the failure judging routine shown in FIG. 5 and the open loop fuel control subroutine is called for.

On the other hand, if the answer to the decision in step S12 is yes, then another decision is made in a step S14: "has the failure flag $O_{xf}=0$ been set ?" If the answer to the decision in the step S14 is no, this indicates that a failure of the oxygen sensor 40 has been detected, then the open loop fuel control subroutine is called for after the execution of the step S13. If, on the other hand, the failure flag $O_{xf}=0$ has been set, this indicates that the decision regarding the activity of the oxygen sensor 40 has not yet been made and the failure decision has not been settled although the failure decision routine was already repeated for the first standby time period $T_1$ under the specified operating condition. Therefore, in this event, the air-to-fuel ratio is altered to enforce a fuel mixture to tend to become rich through steps S15–S17. Although this air-to-fuel ratio altering action is different from the ordinary feedback fuel control, nevertheless, in this embodiment, the feedback correction value $C_{fb}$ used for feedback fuel control is increasingly varied to increase the quantity of fuel to be delivered to the airstream. Specifically, the feedback correction value $C_{fb}$ is increased by a certain value, $\Delta I$, for example approximately 0.4% of the feedback correction value $C_{fb}$ in the step S15, every execution of the fuel discharge control routine. As is apparent from the steps S16 and S17, when the feedback correction value $C_{fb}$ reaches an upper limit value $C_{max}$ previously designed, it is fixed to the upper limit. This upper limit $C_{max}$ of feedback correction value is set to a value smaller than the ordinary maximum feedback correction value $C_{fb}$ which is approximately 25% of an ordinary injected quantity of fuel, for example approximately 15%. Thereafter, the open loop fuel control subroutine shown in FIG. 6 is called for.

Figure 7:
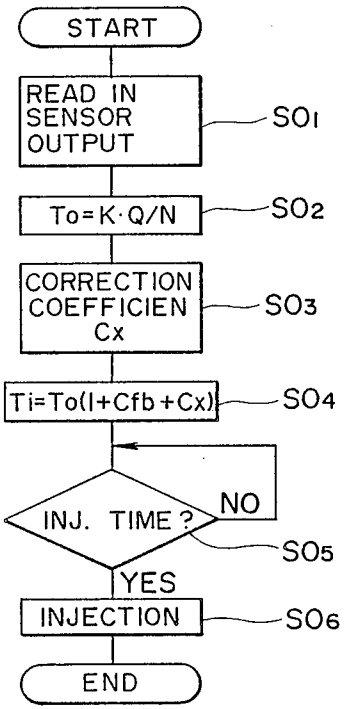
FIG. 7 is a flow chart showing a open loop fuel control subroutine for the microcomputer.

If the answer to the decision regarding the activity of the oxygen sensor 40 is yes, the feedback fuel control subroutine shown in FIG. 7 is called for when the vehicle engine is operated under the feedback control (F.B.) range which is decided in a step S18 and the failure flag $O_{xf}=0$ has been set which is decided in a step S19. Otherwise, the step S13 is taken and the feedback fuel control is suspended.

As is well known, because of exhaust gas recirculation and evaporation purge, a fuel mixture tends to become lean when the vehicle engine operates in a relatively low speed range, for example at a speed in rpm slower than approximately 2,000 rpm. Therefore, it is desirable to execute the activity judgement of the oxygen sensor 40 as early as possible. Such an early activity judgement may be effected by increasing the rising inclination and maximum value of the feedback control value $C_{fx}$ after the lapse of the standby time period $T_1$.

Figure 4B:
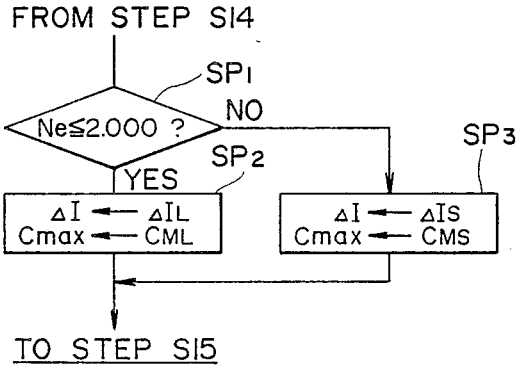
FIG. 4B is a flow chart similar to that of FIG. 4A but showing a fuel control sequential routine in an alternate embodiment of the present invention.

For early execution of the activity judgement, special steps SP1 to SP3 shown in FIG. 4B may be inserted between the steps S14 and S15 of the fuel control routine. If the vehicle engine operates at a speed in rpm higher than 2,000 rpm, an increased value $\Delta I_L$ is set as the certain feedback correction value $\Delta I$ and an increased value $C_{ML}$ is set as the upper limit $C_{max}$ of feedback correction value. On the other hand, when the vehicle engine operates at a speed faster than approximately 2,000 rpm, decreased values $\Delta I_s$ and $C_{MS}$ are set as the certain feedback correction value $\Delta I$ and the upper limit feedback correction value $C_{max}$, respectively. It is to be noted that the increase of $\Delta I$ may be conducted at regular intervals.

Figure 5:
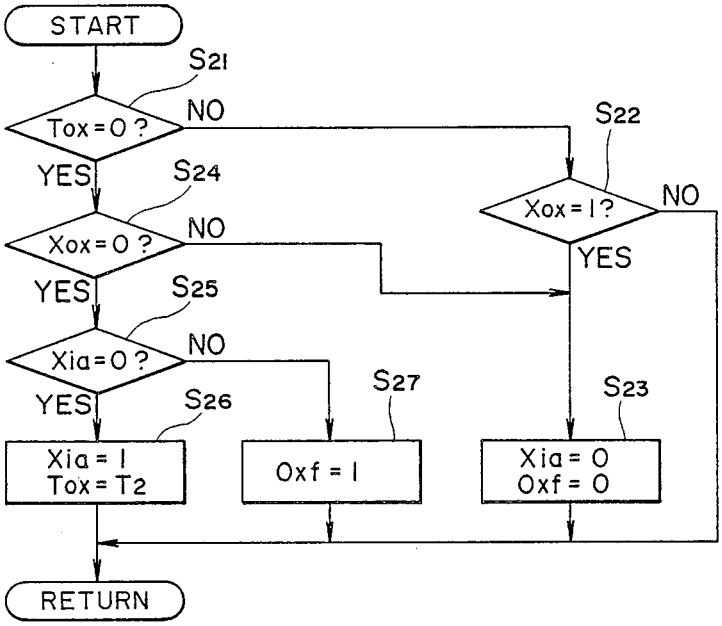
FIG. 5 is a flow chart showing a failure decision sequential routine for the microcomputer.

Referring to FIG. 5 showing a flow chart of the failure decision subroutine, the first step S21 in FIG. 5 is to read the timer counter $T_{ox}$. If the timer counter $T_{ox}$ has counted as many as or more than one, then, the state of activity flag $X_{ox}$ is referred in a step S22. The step S22 orders return directly if the flag $X_{ox}=0$ has been set or, otherwise, after setting the fuel increasing flag $X_{ia}=0$ as well as the failure flag $O_{xf}=0$ in a step S23.

If the answer to the decision regarding the count $T_{ox}$ of the timer counter is yes, this occurs when the count $T_{ox}$ of the timer counter becomes zero as a result of a decrement of one in the step S7 of the timer set routine, then the state of activity flag $X_{ox}$ is referred in a step S24. If the activity flag $X_{ox}=1$ has been set, the step S23 is executed. Otherwise, namely the activity flag $X_{ox}=0$ has been set, a decision regarding the state of the fuel increasing flag $X_{ia}$ is made in a step S25. If the answer to the decision is yes, this indicates the first standby time $T_1$ set in the step S4 has elapsed while the oxygen sensor 17 is left as being not subjected to activity judgement under the specified operating condition. Then, the fuel increasing flag $X_{ia}=1$ is set and the timer counter $T_{ox}$ is set to the second standby time $T_2$, for example 10 secs. in this embodiment.

On the other hand, if the fuel increasing flag $X_{ia}=1$ which indicates that, although the second standby time $T_2$ set either in the step S26 or in the step S6 of the timer setting routine has elapsed and an action to increasing the quantity of fuel delivered to the airstream has been taken through the steps S15 to S17 during the second standby time period $T_2$, no activity judgement of the oxygen sensor 40 was effected. Therefore, the oxygen sensor 40 is decided to be broken down and the failure flag $O_{xf}=1$ is set in a step S27.

Figure 6A:
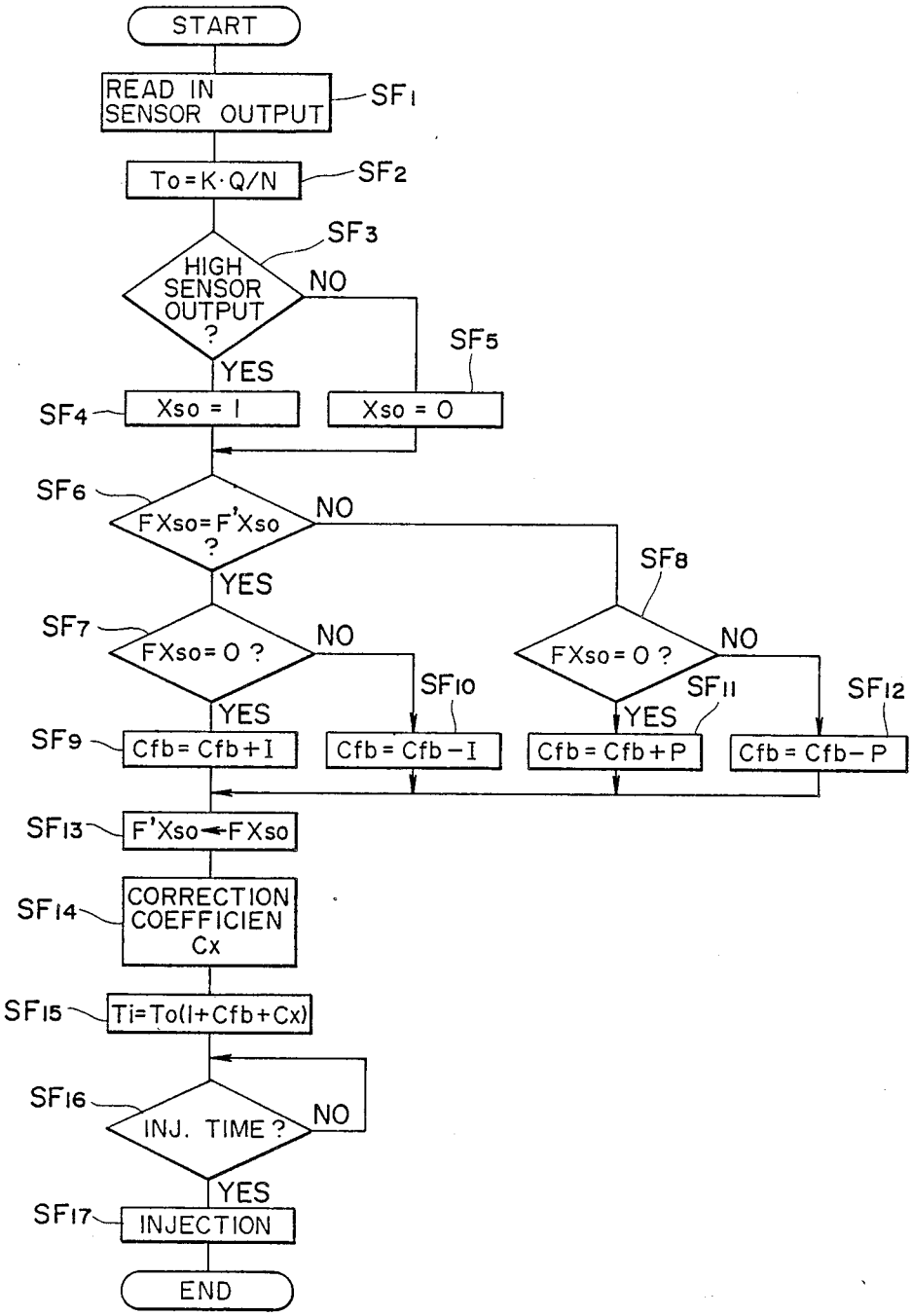
FIG. 6A is a flow chart showing a feedback fuel control subroutine for the microcomputer.

Referring back to the fuel control routine shown in FIG. 4A, if the answer to the decision regarding failure of the oxygen sensor 40 is yes, indicating the oxygen sensor 40 is under a normal operating condition, the feedback fuel control subroutine shown in FIG. 6A is called for. The first step SF1 is to read the output from the sensors such as the air-flow meter 34, throttle valve position sensor 38, oxygen sensor 40, crank angle sensor 44, air flow temperature sensor 46, engine coolant temperature sensor 48, engine rpm sensor 47. Based on the output from the air-flow meter 34 and engine rpm sensor 47, a basic fuel injection time $T_0$ is calculated in a step SF2 by using the following equation:

$$T_0=K\cdot Q/N$$

where

Q is the quantity of intake air

N is rpm of engine

K is constant.

Figure 6B:
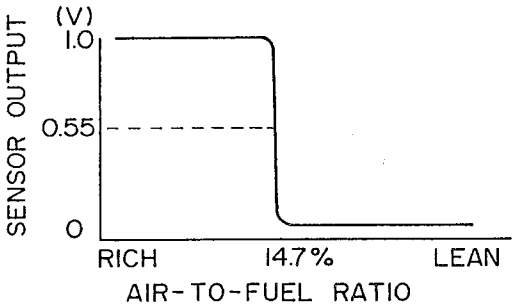
FIG. 6B is a graph showing the relationship of the output of the oxygen sensor relative to the air-to-fuel ratio of a mixture.
Figure 6C:
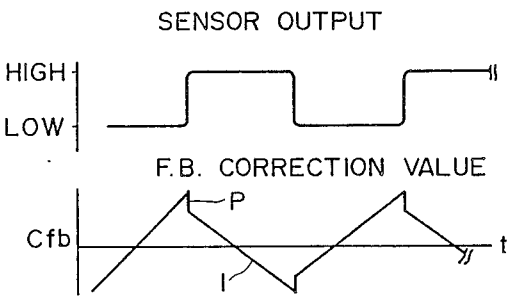
FIG. 6C is graphs showing the relationship between the output of the oxygen sensor and the feedback control value.

Thereafter, a first decision is made in a step SF3: "is the output of the oxygen sensor 40 high?" It is noted that, as is exemplarily shown in FIG. 6A, the oxygen sensor 40 produces a high output when an air-to-fuel mixture is more rich than a perfect mixture called a "stoichiometric" mixture which is around 14.7 parts of air to 1 part of fuel by weight and a low output when more lean as is shown in FIG. 6B. According to the output of the oxygen sensor 40, either an exhaust flag $X_{so}=1$ (which indicates a high output of the oxygen sensor 40 or a rich mixture) or an exhaust flag $X_{so}=0$ (which indicates a low output of the oxygen sensor 40 or a lean mixture) is set in a step SF4 or SF5. Then, another decision is made in a step SF6: "is there any transition between the states of the current and last exhaust flags $X_{so}$?" The answer to the other decision "no" means that the fuel mixture is maintained either rich or lean and "yes" means that the fuel mixture was regulated either increasingly or decreasingly. In any event, the state of the current exhaust flag $FX_{so}$ is examined in step SF7 or SF8. If the exhaust flag $FX_{so}=0$ is detected, the feedback control value $C_{fb}$ is increased by a value P when there occurred a transition of the state of the state of the exhaust flags $FX_{so}$ or by a value I when there was no transition of the state of the exhaust flag $FX_{os}$, according to the output of the oxygen sensor 40. Otherwise, the feedback control value $C_{fb}$ is decreased by a value I or P shown in FIG. 6C. These P (proportional) value and I (integral) value per each revolution of engine are shown in the following table:

| | P value | I value |
|---|---|---|
| Idling | 0.013 | 0.002 |
| Not Idling | 0.047 | 0.004 |

In order to prevent the vehicle engine from being stalled due to hunting, the P and I values are set relatively small when the vehicle engine is idled. On the other hand, for a quick response to reach an intended air-to-fuel ratio, the P and I values are set relatively large when the vehicle engine is not idled.

After the renewing of a feedback control value $C_{fb}$, the current exhaust flag $FX_{so}$ is assumed and set as the last one $F'X_{so}$ for the next feedback fuel control sequence in the step SF13. Then, an actual fuel injection time period $T_i$ is calculated based on the following calculation equation in a step SF15, after the calculation of correcting coefficients represented by $C_x$ in a step SF14:

$$T_i=T_0(1+C_{fb}+C_x)$$

According to a decision regarding an injection timing in a step SF16, the controller 50 causes the fuel injector to inject a regulated quantity of fuel to the air-flow in a step SF17. Thereafter, the general fuel control sequence routine is called for.

FIG. 7 shows a flow chart of the open loop fuel control subroutine which is called for in the event that the feedback control value $C_{fb}$ is set to zero (0) in the step S13 of the general fuel control sequence routine of FIG. 5 or that feedback control value $C_{fb}$ has reached the upper limit value $C_{max}$. As is apparent, this subroutine comprises steps SO1 through SO6 which are the same steps SF1 to SF2 and SF14 to SF17 as of the feedback fuel control subroutine shown in FIG. 6 but without the steps SF3 through SF13 and linked in the same order, so that need not be explained therein.

Figure 8:
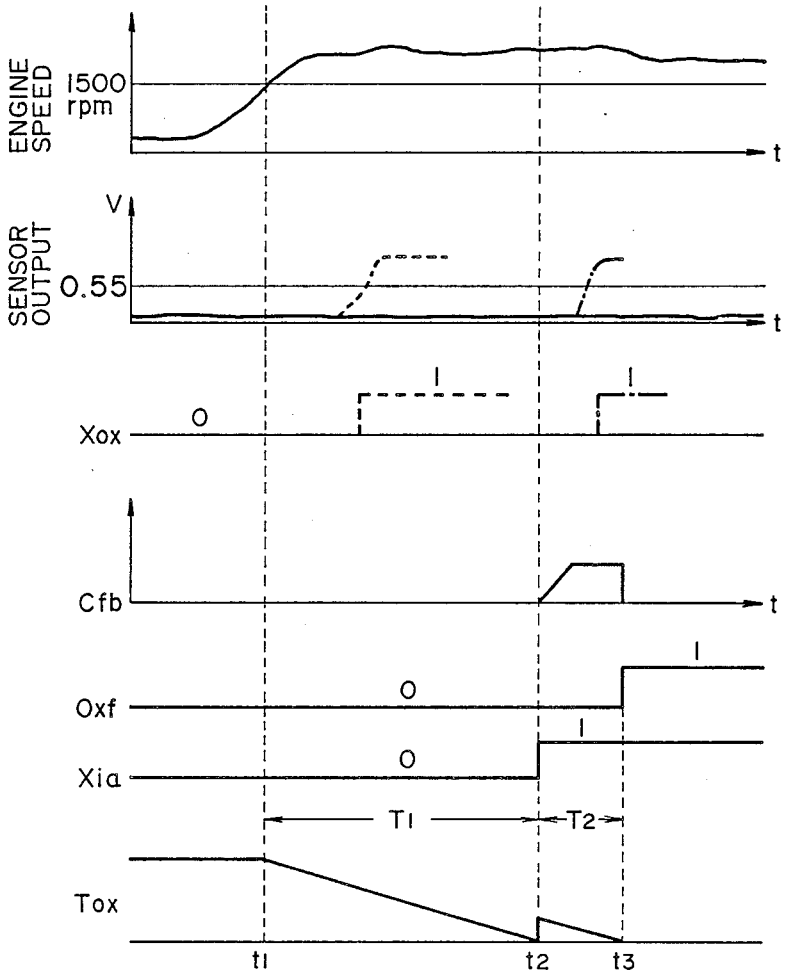
FIG. 8 is a time chart showing a fuel control action of the air-to-fuel control system of FIG. 2.

Reference is now had to FIG. 8 showing a time chart for the purpose of explaining in detail the operation of the air-to-fuel ratio control device according to the present invention. When the vehicle engine in the feedback controllable mode of operation attains an engine speed $N_e$ of 1,500 rpm for the specified engine operating condition at a time $t_1$, the oxygen sensor 40 is examined to decide its activity based on an output thereof in the duration of the first standby time period $T_1$ between the times $t_1$ and $t_2$ while the feedback control value $C_{fb}$ is left at zero (0). In more detail, not only because the oxygen sensor 40 requires a certain time to become active after the vehicle engine starts but because various correction values are established so as to generally make a fuel mixture rich under open fuel control when the vehicle engine is under warming up, when the vehicle engine is turned into the specified operating condition from such an infirm operating condition, the oxygen sensor 40 is examined to decide its activity without any enforced increase of fuel. If, in this time period, the oxygen sensor 40 provides an output higher than a previously specified output voltage of, for example in this embodiment, 0.55 V as is shown by a broken line in FIG. 8, the activity flag $X_{ox}=1$ is set to thereby indicate that the oxygen sensor 40 is operating normally.

Even though the air-to-fuel ratio is established under open fuel control as described above, there is possibly sometimes occurred a lean fuel mixture due to scatter in measured values by the air-flow meter 34 and/or in the quantity of fuel injected by the fuel injector 36. in such the case, if in fact an output from the oxygen sensor 40 does not reach the specified output voltage of 0.55 V even after the lapse of the first standby time period $T_1$, the feedback control value $C_{fb}$ is increasingly varied through the steps S15 through S17 for the second standby time period $T_2$ between the times $t_2$ and $t_3$, enforcing an increase of fuel delivered to the airstream so as to thereby make the fuel mixture rich. When the oxygen sensor 40 provides an output higher than the previously specified output of 0.55 V in the same period of time $t_2$ as is shown by a dotted line in FIG. 8, the activity flag $X_{ox}=1$ is set to thereby indicate that the oxygen sensor 40 is operating normally.

If, although an increase of fuel has been effected, the oxygen sensor 40 still provides an output lower than the previously specified output of 0.55 V, the activity flag $O_{xf}=1$ is set in the step S27 at the end of the second standby time period $T_2$, or the time $t_3$ to thereby indicate that the oxygen sensor 40 is broken down. In such the way as described above, an accurate failure decision of the oxygen sensor is performed.

It is to be noted that an increase of fuel may be effected by using a correction value apart from and in place of the feedback control value $C_{fb}$ increasingly varied in the above described embodiment.

While the present invention has been fully described in conjunction with a preferred embodiment thereof, it will be recognized by those skilled in the art that various changes and modifications of the invention are possible within the scope of the following claims.

What is claimed is:

1. An air-to-fuel ratio control system for a vehicle engine for providing air-to-fuel ratio feedback control of a fuel mixture reaching cylinders of said vehicle engine said air-to-fuel ratio control system comprising:

air-to-fuel ratio regulating means for regulating an air-to-fuel ratio at which said fuel mixture is delivered into said cylinders;

an exhaust sensor disposed in an exhaust system of said vehicle engine for providing an output signal representative of said air-to-fuel ratio of said fuel mixture as determined by exhaust gases delivered from said cylinders;

signal control means for providing said air-to-fuel ratio regulating means with a control signal dependent on said output signal from said exhaust sensor for regulating said air-to-fuel ratio of said fuel mixture to a desired air-to-fuel ratio; and failure judging means for making a judgement of an abnormal operation of said exhaust sensor during suspension of said feedback control of the air-to-fuel ratio when the vehicle engine operates at a specified operating condition;

said failure judging means comprising;

signal judging means for judging said output signal from said exhaust sensor and providing a judging signal when the output signal has caused the regulating means to make said air-to-fuel ratio richer than said desired air-to-fuel ratio;

air-to-fuel ratio altering means responsive to the output signal from the sensor in the absence of said judging signal for providing said air-to-fuel ratio regulating means with an altering signal by which said air-to-fuel ratio is changed to enrich said fuel mixture by a certain value; and judging means for judging that, when said judging signal is provided from said signal judging means, said exhaust sensor is operating normally and that, when no judging signal is provided, the exhaust sensor is operating: (a) normally when said signal judging means judges said output signal from said exhaust sensor has changed so as to make said air-to-fuel ratio of said fuel mixture richer as a result of having caused said air-to-fuel ratio altering means to provide said air-to-fuel ratio regulating means with said altering signal so as to change the air-to-fuel ratio of the fuel mixture and (b) abnormally when said signal judging means judges that said output signal from said exhaust sensor has not changed to a level representing the desired air-to-fuel ratio.

2. A air-to-fuel ratio control system as defined in claim 1, wherein said specified operating condition is defined by a certain vehicle engine speed in rpm.

3. A air-to-fuel ratio control system as defined in claim 2, wherein said certain vehicle engine speed is approximately 1,500 rpm.

4. An air-to-fuel ratio control system as defined in claim 1, wherein said air-to-fuel altering means gradually alters an air-to-fuel ratio so as to make the fuel mixture richer.

5. An air-to-fuel ratio control system as defined in claim 4, wherein said air-to-fuel ratio altering means alters said air-to-fuel ratio more rapidly when said vehicle engine operates at a low speed in rpm than at a high speed.

6. An air-to-fuel ratio control system as defined in claim 4, wherein said air-to-fuel ratio altering means alters said air-to-fuel ratio by changing a feedback correction value in said feedback control of air-to-fuel ratio.

7. An air-to-fuel ratio control system as defined in claim 6, wherein said feedback correction value is changed to an upper limit value previously set.

8. A air-to-fuel ratio control system as defined in claim 7, wherein said upper limit value is smaller than a maximum value with which said air-to-fuel ratio control system can effect said feedback control of air-to-fuel ratio.

9. A air-to-fuel ratio control system as defined in claim 7, wherein said upper limit value is larger when said vehicle engine operates at a low speed in rpm than at a high speed.

* * * * *